US006205830B1

(12) United States Patent
Voges

(10) Patent No.: US 6,205,830 B1
(45) Date of Patent: Mar. 27, 2001

(54) METHOD AND APPARATUS FOR PROCESSING SHEET METAL

(75) Inventor: Kevin Voges, Red Bud, IL (US)

(73) Assignee: The Material Works, Ltd., Red Bud, IL (US)

( * ) Notice: Subject to any disclaimer, the term of this patent is extended or adjusted under 35 U.S.C. 154(b) by 0 days.

(21) Appl. No.: 09/512,686

(22) Filed: Feb. 24, 2000

(51) Int. Cl.[7] ..... B21D 1/06; B21D 25/00; B21C 43/04

(52) U.S. Cl. ..... 72/40; 72/161; 72/302

(58) Field of Search ..... 72/302, 301, 161, 72/160, 40, 39

(56) References Cited

U.S. PATENT DOCUMENTS

| | | | | |
|---|---|---|---|---|
| 2,449,507 | * | 9/1948 | Pope | 72/302 |
| 3,686,921 | * | 8/1972 | Roper | 72/302 |
| 3,722,251 | * | 3/1973 | Withrow | 72/302 |
| 3,753,522 | | 8/1973 | Voges . | |
| 3,924,428 | * | 12/1975 | Noe | 72/161 |
| 4,312,325 | | 1/1982 | Voges et al. . | |
| 4,539,830 | * | 9/1985 | Noe | 72/161 |
| 4,751,838 | | 6/1988 | Voges . | |
| 4,872,245 | * | 10/1989 | Kawasaki | 72/40 |
| 4,887,502 | | 12/1989 | Voges . | |
| 4,982,593 | | 1/1991 | Holloway . | |
| 5,077,887 | | 1/1992 | Holloway . | |
| 5,181,411 | | 1/1993 | Holloway . | |
| 5,579,658 | * | 12/1996 | Noe | 72/161 |
| 5,759,307 | * | 6/1998 | Berger | 148/603 |
| 5,820,704 | * | 10/1998 | Veyer | 148/610 |
| 5,829,287 | * | 11/1998 | Noe | 72/161 |

FOREIGN PATENT DOCUMENTS

| | | | | |
|---|---|---|---|---|
| 1452957 | * | 4/1963 | (DE) | 72/302 |
| 116902 | * | 7/1983 | (JP) | 72/161 |
| 498038 | * | 8/1992 | (JP) | 72/161 |
| 158862 | * | 11/1963 | (SU) | 72/302 |

OTHER PUBLICATIONS

3M Scotch–Brite Product Brochure, 1993.
Leveltek International, LLC website information, Circa 1999.

* cited by examiner

*Primary Examiner*—Daniel C. Crane
(74) *Attorney, Agent, or Firm*—Howell & Haferkamp, LC

(57) ABSTRACT

A sheet metal processing apparatus comprises a stretcher-leveler and a surface conditioner in combination. The stretcher leveler has an input end, an output end, and a stretching mechanism between the input and output ends. The input end of the stretcher-leveler is adapted to receive at least a portion of a metal sheet to be processed. The stretching mechanism has a plurality of gripping members. The gripping members are adapted for gripping the metal sheet and stretching the portion of the metal sheet between the gripping members past its yield point to eliminate internal residual stresses therein. The stretcher-leveler is adapted to then discharge the stretched portion of the metal sheet from the output end of the stretcher-leveler. A surface conditioner is positioned adjacent the output end of the stretcher-leveler. The surface conditioner is adapted to receive the portion of the metal sheet discharged from the output end of the stretcher-leveler. The surface conditioner has at least one rotating conditioning member adapted for engagement with a surface of the metal sheet.

21 Claims, 5 Drawing Sheets

METHOD AND APPARATUS FOR PROCESSING SHEET METAL

FIELD OF THE INVENTION

The present invention relates to flat rolled metal and sheet metal processing. More particularly, the present invention relates to a method and apparatus for leveling and conditioning sheet metal using a stretcher-leveling machine in combination with a surface conditioning system.

BACKGROUND OF THE INVENTION

A wide variety of manufactured goods contain processed sheet metal. For example, aircraft, automobiles, file cabinets and household appliances, to name only a few, contain sheet metal. The sheet metal is typically purchased directly from steel mills and/or steel service centers, but may be passed through intermediate processors (sometimes referred to as "toll" processors) before it is received by an original equipment manufacturer.

Various methods exist for flattening sheet metal and for conditioning the surfaces thereof. Flatness of sheet metal is important because virtually all stamping and blanking operations require a flat sheet. Also, in certain applications, such as in the aerospace industry, residual stress free material is critical. Good surface conditions are also important, especially in applications where the top and/or bottom surfaces of the metal sheet will be painted.

There are a number of common defects that effect sheet metal flatness. For example, when sheet metal is rolled into coil form for convenient storage and transportation, the strip takes on a coiled shape. This curvature is commonly referred to as "coil set." Coil set occurs because the sheet metal has been bent past its yield point. More specifically, when sheet metal is coiled, the metal fibers near the inside surface of the curved sheet are compressed past their yield point, and the metal fibers near the outside surface of the curved sheet are stretched past their yield point. Another type of shape defect known as "edge wave" occurs if the edge portions of the sheet are longer than the center portion of the sheet, resulting in undulations in one or both of the edge portions of the sheet. A similar type of shape defect known as "center buckle" results if the center portion of the sheet is longer than one or both of the edge portions, which results in bulging or undulating of the central portion of the sheet.

One method of removing coil set in sheet metal is "straightening." A conventional straightener is shown schematically in FIG. 1. In a straightener process, a strip of sheet metal S is advanced through a series of large diameter upper rollers U and lower rollers L, which are positioned relative to one another to put deep upward and downward bends in the sheet sufficient to reverse the coil set. However, straightening can only remove coil set and some cross bow. It is a rather crude and imprecise method that is typically used only as a first pass.

Another conventional method of flattening sheet metal is "roller leveling." A conventional roller leveler, shown schematically in FIG. 2, comprises a top set of small diameter rollers T and a bottom set of small diameter rollers B mounted in a frame (not shown) so that top and bottom sets of rollers are offset from one another. A series of larger diameter "back-up" rollers R engage the small diameter rollers T and B and can be adjusted as needed to flatten the material moving through the top and bottom rollers T and B. A strip of sheet metal S is advanced between the top and bottom sets of small diameter rollers T and B and is alternately flexed upwardly and downwardly between the top and bottom rollers such that the amount of flexing decreases as the sheet travels toward the exit end E of the roller leveler. The small diameter rollers T and B work the sheet S by bending the metal fibers near the inside surface of the curve and the metal fibers near the outside of the curve past their yield point (i.e., beyond their elastic limit). A roller leveler produces a reasonably flat metal sheet, but is extremely difficult to operate and requires a highly skilled operator. Moreover, the roller leveling process itself is less than ideal because there still exists a neutral axis in the sheet metal where the yield point of the metal has not been exceeded by the small diameter rollers. Metal fibers lying at or near this neutral axis may be in a stressed condition (and tend to spring back toward their original shape) because they have not been deformed past their elastic limit. Therefore, even after roller leveling, the material at or near the neutral axis will possess internal residual stresses because the grain structure is not uniform. Also, roller leveling alone does nothing to remove scale and corrosion from the surface of the sheet metal.

Another method of flattening sheet metal is "temper passing." A conventional "2-high" temper mill cut-to-length line is shown schematically in FIG. 3, along with a roller leveler L and a shearing machine M. The "2-high" temper mill comprises two large diameter rollers D that significantly compress the metal fibers at the top and bottom of the metal sheet S into uniformity. This results in a substantial reduction of internal residual stresses at the top and bottom surfaces of the metal sheet, but typically does not work the fibers near the neutral axis of the metal sheet past their yield point. Therefore, even after a 2-high temper passing process, the material at or near the neutral axis may still possess internal residual stresses and the material may not be sufficiently flat. A 2-high temper passing process does little to remove scale and corrosion from the surface of the sheet metal. In fact, because of the substantial compressive forces applied to the top and bottom surfaces of the sheet metal by the temper passing rolls, surface scale tends to become embedded in the metal surface, which can increase the likelihood of point source corrosion and consequent rusting.

"Temper passing" can also be accomplished with "4-high" temper mill (not shown), which comprises two upper rolls (an upper sheet engaging roll and a back up roll therefor) and two lower rolls (a lower sheet engaging roll and a back up roll therefor) all generally aligned in a vertical plane. The two sheet engaging rolls are much smaller in diameter than the rollers D of a "2-high" temper mill. As such, the two sheet engaging rolls of the "4-high" temper mill apply a more concentrated force at the point of contact. Like the "2-high" temper mill, the "4-high" temper mill significantly compress the metal fibers at the top and bottom of the metal sheet into uniformity, resulting in a substantial reduction of internal residual stresses at the top and bottom surfaces of the metal sheet. However, like the "2-high" temper mill, the "4-high" temper mill also fails to work the fibers near the neutral axis of the metal sheet past their yield point. "4-high" temper mills tend to do a better job of removing scale and corrosion than "2-high" temper mills.

In some applications, a certain amount of crown (i.e., thicker gauge in the center than at the ends) may be desired. A problem with both "2-high" and "4-high" temper mills is crown reduction (known as "feathering") in which the crown in the metal sheet is compressed out by the temper mill's rollers.

Another method of flattening sheet metal is "stretcher leveling." A conventional C-frame stretcher leveler is shown schematically in FIG. 4. Stretcher leveling is generally considered to be a superior flattening process because, unlike roller leveling and temper processing, it rectifies the problem of internal residual stresses and produces a flatter product without crown reduction. As shown in FIG. 4, a typical C-frame stretcher leveler includes a pair of generally C-shaped grippers or jaws G that securely grip the opposing ends of the sheet S to be stretched. The surface portions of the grippers that engage or grip the sheet metal to hold the sheet against movement during stretching are typically grooved, knurled or serrated to provide a secure grip. In operation, the grippers G are hydraulically or pneumatically controlled to engage the opposed ends of the sheet S and, once a firm contact is made, hydraulic actuators (not shown) move the grippers in opposite directions from one another to stretch the metal sheet S held therebetween. The entire cross section of the metal sheet is stretched past its yield point (i.e., beyond its elastic limit) such that all internal residual stresses are eliminated from top to bottom and from side to side. However, a problem with a conventional C-frame stretcher leveler is that it cannot be used with continuous strips of metal because the C-shaped grippers clamp at the opposed ends of a metal sheet, as shown in FIG. 4. Another problem with conventional C-frame stretcher levelers is that the grippers bite deeply into the metal and disfigure the top and bottom surfaces of the sheet. Traditionally, the disfigured portions of the sheet are cut off as scrap, which results in a substantial amount of wasted material. Also, operation of a C-frame stretcher leveler is very labor intensive because the individual sheets must be moved into and out of the machine between operations. Aside from cutting off the disfigured portions, conventional C-frame stretcher levelers do nothing to improve the surface quality of the sheet metal.

U.S. Pat. No. 4,751,838, issued to Kenneth Voges, discloses an "in-line stretcher leveler." The teachings of this patent are incorporated herein by reference. The basic components of conventional in-line stretcher leveler are shown schematically in FIG. 5. As shown in FIG. 5, a typical in-line stretcher leveler includes a first set of upper and lower gripping members $G_{U1}$ and $G_{L1}$ and a second set of upper and lower gripping members $G_{U2}$ and $G_{L2}$. The gripping members are hydraulically or pneumatically controlled to engage top and bottom surfaces of the metal sheet S and, once a firm contact is made, hydraulic actuators (not shown) move the first and second sets of gripping members in opposite directions from one another to stretch the segment of the metal sheet S positioned between the two pairs of gripping members. Then, the gripping members are released and the metal sheet S is advanced so that the next section of the metal sheet can be stretched. Because the gripping members of the in-line stretcher leveler engage the metal sheet from the top and bottom, rather than at opposing ends, the in-line stretcher leveler can be used to stretch any length of sheet metal by successive stretching operations wherein the metal sheet is successively advanced through the stretcher leveler after each stretching operation. As disclosed in U.S. Pat. No. 4,751,838, unlike the grippers of the C-frame stretcher leveler, the gripping members $G_{U1}$, $G_{L1}$, $G_{U2}$ and $G_{L2}$ of the in-line stretcher leveler preferably have engagement surfaces that are sufficiently smooth to avoid marring or otherwise disfiguring the surfaces of the metal sheet S. This is particularly advantageous because there are no disfigured portions to be cut off as scrap, which results in substantial cost savings. Also, this process is far less labor intensive than C-frame stretcher leveling. However, the in-line stretcher leveler disclosed in U.S. Pat. No. 4,751,838 does nothing to improve the surface quality of the sheet metal.

One known method of conditioning the surface of sheet metal is commonly referred to as "pickling." Pickling is a cleaning process used to remove black oxide scale and other smut that has formed on the sheet metal surface. In a typical pickling process, the metal sheet is run through a hydrochloric acid bath, a rinse tank, an air dryer, and an oiling station. The oil is applied to prevent corrosion of the bare metal surface. An advantage of pickling is that the sheet metal does not need to be perfectly flat, because the hydrochloric acid bath is typically deep enough to accommodate for some waviness caused by internal residual stresses. However, pickling does nothing to improve flatness.

Thus, there is a need for a sheet metal processing apparatus that incorporates the benefits of an in-line stretcher leveler together with a surface conditioning apparatus that removes scale and other smut from the surface in a continuous strip of sheet metal.

SUMMARY OF THE INVENTION

It is a principal object of the present invention to provide a method and apparatus for processing sheet metal that incorporates the benefits of stretcher leveling, for eliminating substantially all internal residual stresses in the metal sheet, and also incorporates the benefits of a surface conditioning process that employs mildly abrasive, rotating cleaning brushes, which are brought into engagement with the surface of the sheet metal to remove scale and other smut from the surface. Another object of the invention is to provide a sheet metal processing apparatus that incorporates a stretcher leveler and a surface conditioning process together in-line to reduce material handling costs. Still another object is to provide a metal processing apparatus that is capable of removing internal residual stresses from sheet metal and flat rolled metal having a wide range of gauges covering the entire hot-rolled spectrum. A further object of the invention is to provide a sheet metal processing apparatus that is easier and more economical to run than conventional temper mills. Still another object is to provide a metal processing apparatus that provides superior flattening without causing undesired crown reduction. Another object is to provide a metal processing apparatus that is capable of providing superior flatness even in severely deformed metal coils and conditioning the surface, thus allowing the seller of sheet metal to purchase or source their coil metal from virtually any mill.

In general, a metal processing apparatus of the present invention comprises a stretcher-leveler and a surface conditioner. The stretcher-leveler has a plurality of gripping members adapted for gripping a metal sheet to be processed. The gripping members are adapted for stretching at least a portion of the metal sheet past its yield point to eliminate internal residual stresses therein. The surface conditioner is positioned adjacent the stretcher-leveler. The surface conditioner has at least one rotating conditioning member adapted for engagement with a surface of the portion of the metal sheet.

In another aspect of the invention, a stretcher-leveler has an input end, an output end, and a stretching mechanism between the input and output ends. The input end of the stretcher-leveler is adapted to receive at least a portion of a metal sheet to be processed. The stretching mechanism has a plurality of gripping members. The gripping members are adapted for gripping the metal sheet and stretching the portion of the metal sheet between the gripping members past its yield point to eliminate internal residual stresses therein. The stretcher-leveler is adapted to then discharge the stretched portion of the metal sheet from the output end of the stretcher-leveler. A surface conditioner is positioned adjacent the output end of the stretcher-leveler. The surface conditioner is adapted to receive the portion of the metal sheet discharged from the output end of the stretcher-leveler. The surface conditioner has at least one rotating conditioning member adapted for engagement with a surface of the metal sheet.

In yet another aspect of the invention, a method of processing sheet metal comprises the steps of providing a stretcher-leveling apparatus, providing a surface conditioning apparatus, stretching at least a portion of a metal sheet with the stretcher-leveling apparatus, and conditioning a surface of the portion of the metal sheet with the surface conditioning apparatus. The stretcher-leveling apparatus is used to stretch the portion of the metal sheet past its yield point an amount sufficient to eliminate internal residual stresses in the portion of the metal sheet and produce a flat product. The surface conditioning apparatus includes at least one rotating conditioning member, which is brought into engagement with the surface of the portion of the metal sheet.

In still another aspect of the invention, a method of leveling and surface-conditioning sheet metal comprises the steps of providing a stretcher-leveling apparatus having first and second pairs of gripping members, providing a surface conditioning apparatus, feeding a metal sheet to be stretched into the stretcher-leveling apparatus, gripping the metal sheet with the first and second pairs of gripping members, stretching a portion of the metal sheet between the first and second pairs of gripping members, and conditioning a surface of the portion of the metal sheet with the surface conditioning apparatus. The portion of the metal sheet between the first and second pairs of gripping members is stretched by moving the first and second pairs of gripping members in opposite directions from one another. The surface conditioning apparatus includes at least one rotating conditioning member with a generally cylindrical conditioning surface. The surface conditioning apparatus is used to condition a surface of the portion of the metal sheet by bringing the generally cylindrical conditioning surface of the rotating conditioning member into engagement with the surface of the portion of the metal sheet.

A further aspect of the present invention includes a method of leveling and surface-conditioning a continuous length of sheet metal, in-line, with successive stretching and conditioning operations. The method comprises the steps of providing, a stretcher-leveler, providing a surface conditioner adjacent an output end of the stretcher-leveler, advancing the continuous length of sheet metal through the stretcher-leveler in a manner so that successive adjacent portions of the continuous length of sheet metal are stretched by a stretching mechanism of the stretcher-leveler in successive stretching operations, and advancing the continuous length of sheet metal through the surface conditioner in a manner so that successive adjacent surface portions of the continuous length of sheet metal are conditioned by at least one rotating conditioning member of the surface conditioner.

While the principal advantages and features of the present invention have been described above, a more complete and thorough understanding and appreciation for the invention may be attained by referring to the drawings and description of the preferred embodiments, which follow.

Figure 1:
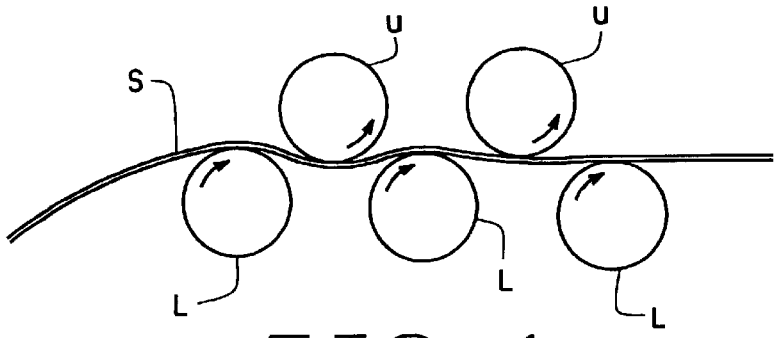
FIG. 1 PRIOR ART
FIG. 1 is a schematic representation of a conventional straightener.
Figure 2:
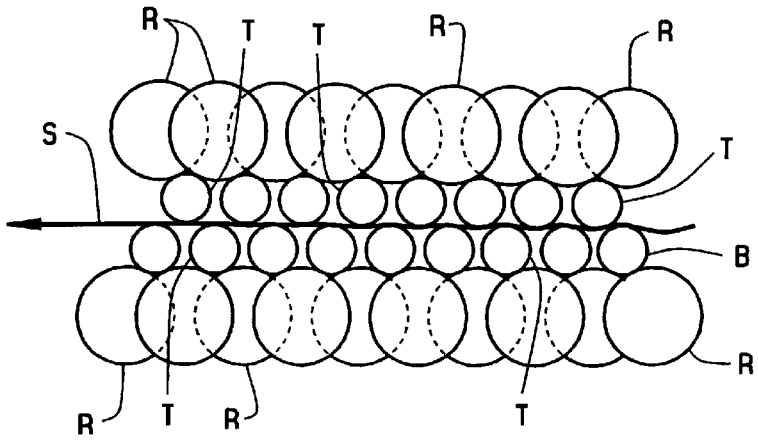
FIG. 2 PRIOR ART
FIG. 2 is a schematic representation of a conventional roller leveler.
Figure 3:
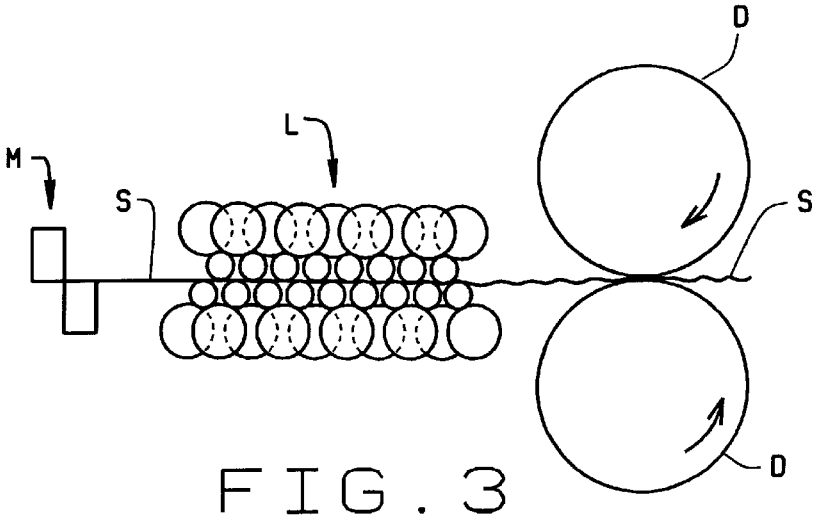
FIG. 3 PRIOR ART
FIG. 3 is a schematic representation of a conventional 2-high temper passing process.
Figure 4:
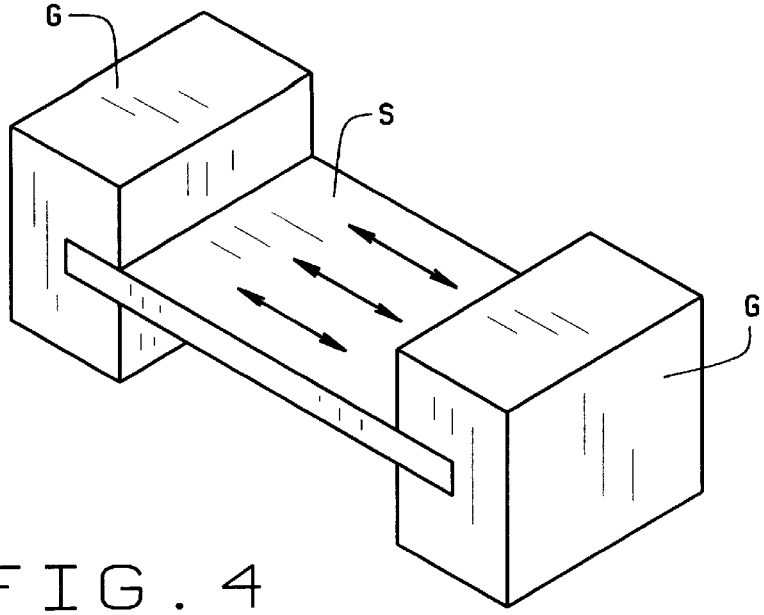
FIG. 4 PRIOR ART
FIG. 4 is a schematic representation of a conventional C-frame stretcher leveler.
Figure 5:
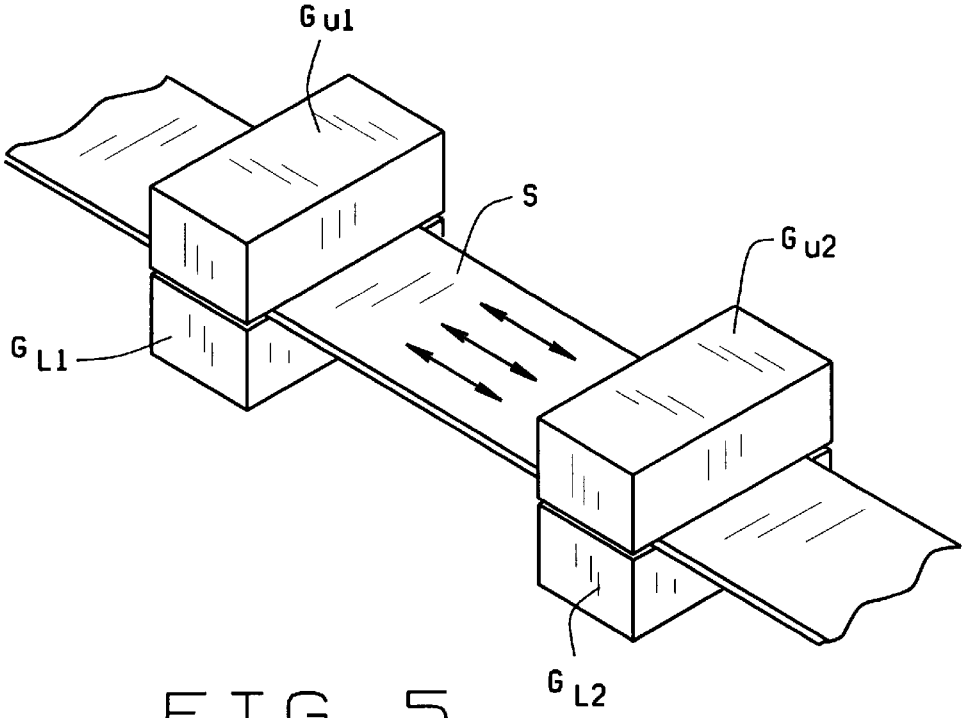
FIG. 5 PRIOR ART
FIG. 5 is a schematic representation of a conventional in-line stretcher leveler.

Reference characters in these Figures correspond to reference characters in the following detailed description of the preferred embodiments.

DETAILED DESCRIPTION OF THE PREFERRED EMBODIMENTS

Figure 6:
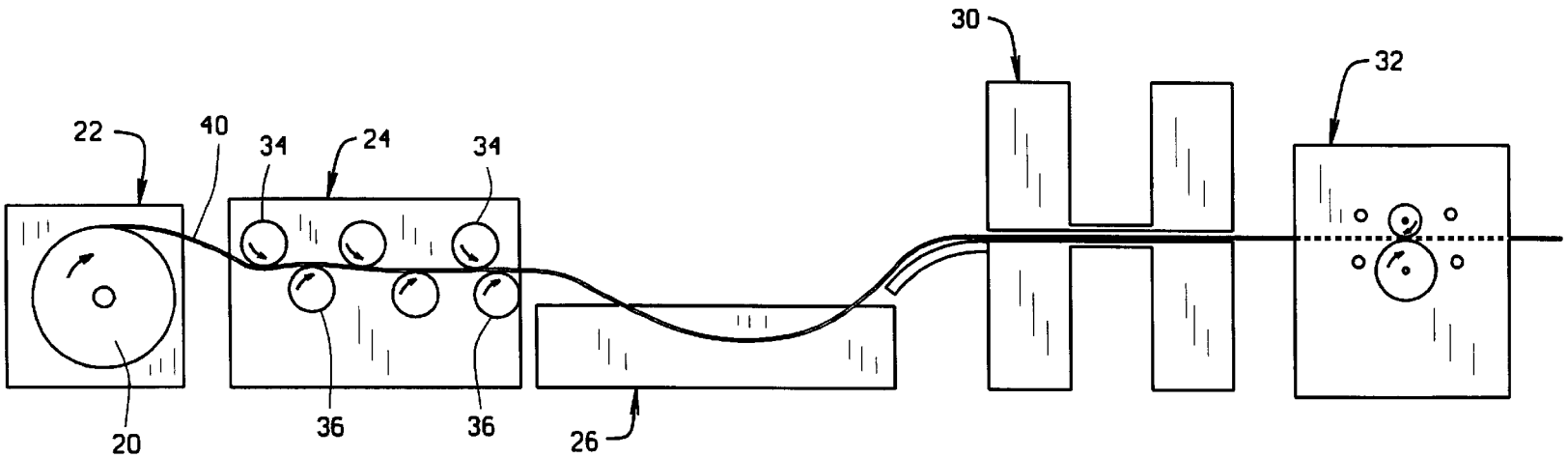
FIG. 6 is schematic representation of an in-line metal processing apparatus of the present invention, the apparatus being illustrated with other machines and apparatus with which it may be used.

An in-line metal processing apparatus of the present invention is shown generally in FIG. 6, along with other machines and apparatus with which it may be used. In general, FIG. 6 shows a coil of sheet metal 20 mounted on a reel 22, a straightener 24, a take up pit 26, a stretcher leveler 30 and a surface conditioner 32.

As shown in FIG. 6, the straightner roller 24 is positioned just downstream of the reel 22. The straightener 24 includes a plurality of upper rollers 34 and lower rollers 36 having a relatively large diameter. At least some of the rollers are powered to withdraw a sheet metal strip 40 from the coil 20 at a uniform velocity. The upper and lower rollers 34 and 36 are positioned relative to one another to put a deep reverse bend in the sheet 40 sufficient to reverse the coil set. The reel 22 and straightener 24 are conventional.

The take up pit 26 is positioned just downstream of the straightener 24. As explained below in greater detail, a feeding mechanism of the stretcher leveler 30 advances the sheet metal strip 40 incrementally through the stretcher leveler 30 for successive stretching operations. The take up pit 26 is positioned at the exit end of the straightener 24 to permit the continuous strip exiting from the straighter roller at a constant velocity to accumulate during the short periods of time that the portions of the sheet metal strip 40 advancing incrementally through the stretcher leveler 30 are at rest. The take up pit 26 is also conventional.

The stretcher leveler 30 includes a feeding mechanism (not shown), including a plurality of powered rollers for pulling the sheet metal strip 40 through the stretcher leveler 30. As explained below in greater detail, the feeding mechanism advances the sheet metal strip 40 through the stretcher leveler 30 at precisely measured increments. Between the incremental advances of the strip 40, the stretcher leveler 30 clamps down on a segment of the strip 40 that is within the stretcher leveler and stretches that segment beyond its yield point to eliminate internal residual stresses, thereby leveling that segment. After the segment has been stretched, the stretcher leveler 30 releases the strip 40 and the strip is advanced so that the next segment can be stretched.

Preferably, the length of the incremental advances of the strip 40 does not exceed the length of the segment being stretched, so the entire strip 40 can be stretched through the successive stretching operations.

As shown in FIG. 6, the surface conditioning apparatus 32 is positioned just downstream of the stretcher leveler 30. As explained below in more detail, the surface conditioning apparatus 32 includes at least one mildly abrasive, rotating cleaning brush (shown in FIG. 8). The brush is brought into engagement with a surface of the sheet metal strip 40 to remove scale and other smut from the surface. Preferably, a coolant and lubricant, such as water, is applied to the brush during the cleaning operation to produce a cooler running operation, to wash away cleaning by-products, and to extend the life and effectiveness of the brush.

Figure 7:
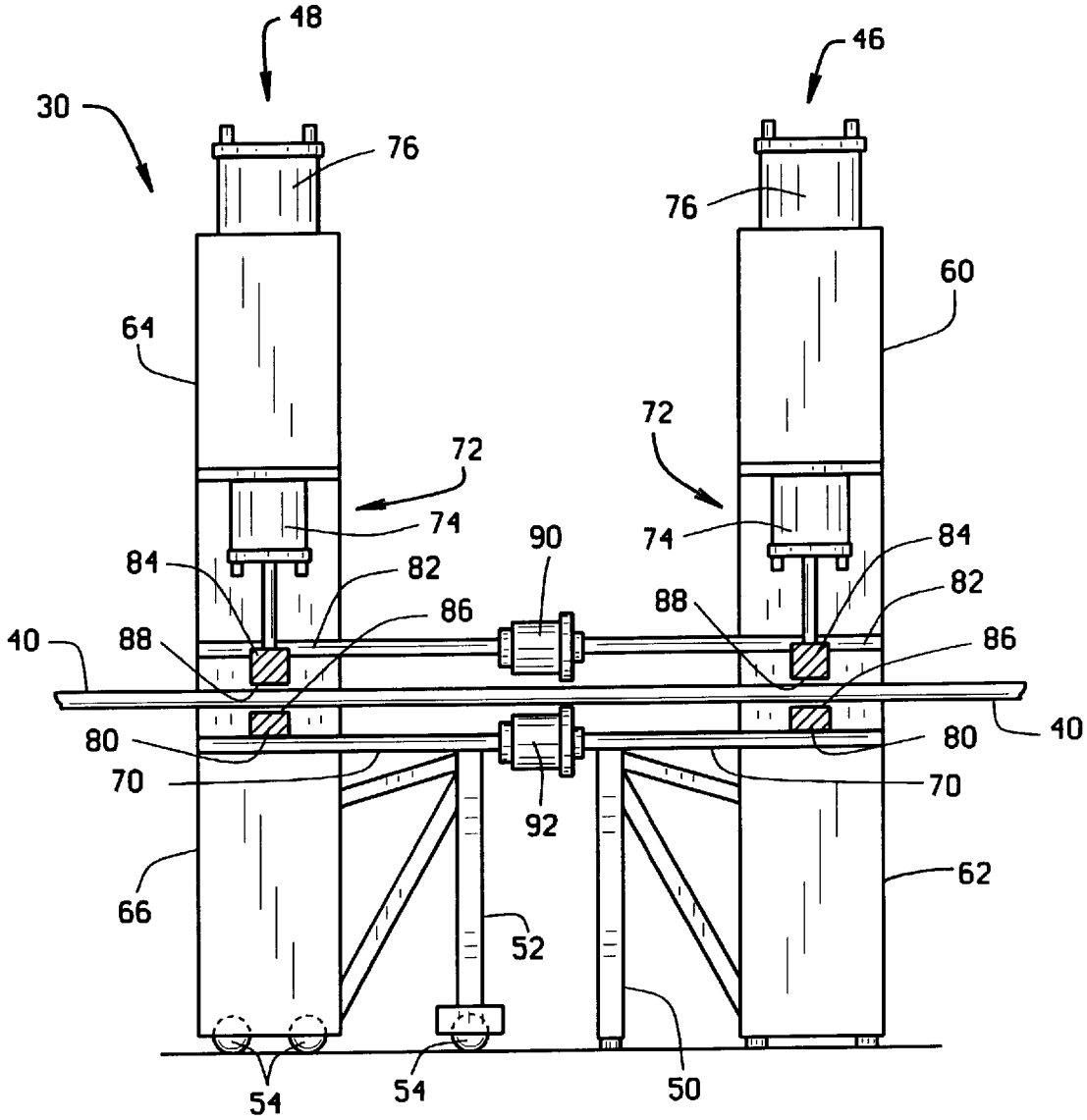
FIG. 7 is a side elevational view, in partial cross-section, of the stretcher leveler component of the in-line metal processing apparatus of the present invention.

FIG. 7 is an enlarged cross-sectional side of the stretcher leveler 30 of FIG. 6. The stretcher leveler 30 includes a fixed frame 46 and a moveable frame 48. The fixed frame 46 includes legs 50, which are anchored firmly to the floor. The moveable frame 48 includes legs 52 having wheels 54, which allow it to move along the floor toward and away from the fixed frame 46. Preferably, the wheels 54 rest upon and follow tracks (not shown) that extend parallel to the direction of advancement of the sheet metal strip 40. The fixed frame 46 includes an upper frame portion 60 and a lower frame portion 62. Similarly, the moveable frame 46 includes an upper frame portion 64 and a lower frame portion 66. The sheet metal strip 40 passes generally horizontally through the space between the upper frame portions 60 and 64 and the lower frame portions 62 and 66. As shown in FIG. 7, the lower frames portions include horizontal guide plates 70, which support the strip 40 as it is advanced through the stretcher leveler.

Each of the upper frame portions 60 and 64 includes a clamping mechanism, represented generally as 72. As will be explained, the clamping mechanisms 72 move upwardly and downwardly on the upper frame portions 60 and 64 on which they are carried. The downward movement of the clamping mechanisms 72 is imparted by hydraulic clamping cylinders 74 mounted near the lower ends of the upper frame portions 60 and 64. The upward movement of the clamping mechanisms 72 is imparted by hydraulic lifting cylinders 76 mounted near the upper ends of the upper frame portions 60 and 64. The downward movement of the clamping mechanisms 72 serves to grip the strip 40 so that the strip can be stretched, and the upward movement of the clamping mechanisms 72 merely serves to lift the clamping assemblies high enough to give sufficient clearance for the strip 40 to be advanced through the stretcher leveler for the next stretching operation. Thus, preferably, the force applied by clamping cylinders 74 is substantially greater than the force applied by lifting cylinders 76.

The lower frame portions 62 and 66 support lower gripping members 80, which are mounted securely thereon and preferably extend the full width of the frames 46 and 48. The clamping mechanisms 72 each include a clamp plate 82, which carries similar upper gripping members 84 that preferably extend the full width of the frames 46 and 48. Preferably, the gripping members 80 and 84 have smooth engagement surfaces 86 and 88 that will not mar or otherwise disfigure the surfaces of the sheet metal strip 40 held therebetween. U.S. Pat. No. 4,982,593, issued to Bertram A. Holloway, teaches that the gripping members are preferably of a high density polymeric material, such as Adiprene®, with a durometer hardness of between 60 and 95 on the "D" scale and between 75 and 95 on the "A" scale, although the gripping members 80 and 84 could be made of other suitable materials without departing from the scope of the present invention. The teachings of U.S. Pat. No. 4,982,593 are incorporated herein by reference.

When the gripping members 80 and 84 are forced together by the clamping cylinders 74, the friction between the opposing engagement surfaces 86 and 88 and the sheet metal strip 40 captured therebetween is sufficient to prevent the strip 40 from slipping from the gripping members when the frames 46 and 48 are urged apart from one another with sufficient force to stretch the entire cross-section of the sheet metal strip 40 past its yield point. The smooth surfaces of the gripping members prevent marring or other disfigurement to the surfaces of the sheet metal strip 40.

Preferably, the force for urging the moveable frame 48 away from the fixed frame 46 is supplied by upper and lower sets of hydraulic cylinders 90 and 92, which are positioned between the two frames 46 and 48. Together, the upper and lower sets of hydraulic cylinders 90 and 92 move the moveable frame 48 away from the fixed frame 46 during stretching operations. Preferably, the hydraulic cylinders 90 and 92 can be operated in both directions (as "spreading cylinders" for urging the moveable frame 48 away from the fixed frame 46, and also as "return cylinders" for moving the moveable frame 48 back toward the fixed frame 46 for the next stretching operation). Alternatively, the stretcher leveler 30 may include separate "return cylinders" (not shown) mounted between the frames 46 and 48 for moving the moveable frame 48 back toward the fixed frame 46 for the next stretching operation.

Thus, in operation, the feeding mechanism of the stretcher leveler 30 draws the sheet metal strip 40 from the take up pit 26. With the clamping mechanisms 72 in the up position, the sheet metal strip is fed between the upper and lower gripping members 80 and 84, and the return cylinders (now shown) are energized to return the moveable frame 48 toward the fixed frame 46 to a suitable position to begin the next stretching operation. With the moveable frame 48 properly positioned relative the fixed frame 46, the clamping cylinders 74 are energized on each of the upper frame portions 60 and 64 to move the clamping mechanisms 72 downwardly to bring the upper gripping members 84 into firm engagement with the top surface of the sheet metal strip 40. The upper gripping members 84 approach the lower gripping members 80 so that the sheet metal strip 40 is gripped firmly therebetween. With the strip 40 tightly gripped between the upper and lower gripping members 80 and 84, the hydraulic cylinders 90 and 92 are energized to move the moveable frame 48 away from the fixed frame 46 to stretch that portion of the sheet metal strip 40 between the gripping members 80 and 84 of the fixed frame 46 and the gripping members 80 and 84 of the moveable frame 48 past its yield point to remove substantially all internal residual stresses in that portion of the strip 40. Then, the clamping cylinders 74 remain energized while the spreading cylinders 90 and 92 are released. This allows the portion of the strip that was stretched to recover at least some of its elastic deformation, which may bring the moveable frame 48 back toward the fixed frame 46 a short distance. Thereafter, the clamping cylinders 74 are released and the lifting cylinders 76 are energized to lift the clamping mechanisms 72 upwardly a distance sufficient to clear the way for the strip 40 to be advanced by the feeding mechanism for the next stretching operation.

Figure 8:
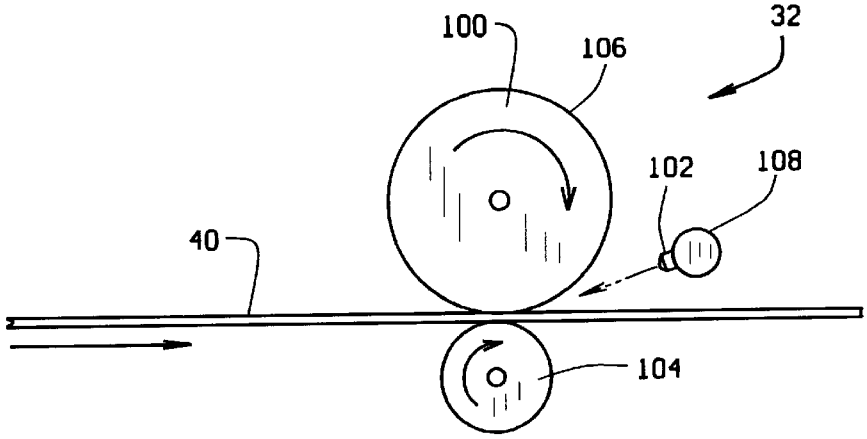
FIG. 8 is a side elevational view of the surface conditioning component of the in-line metal processing apparatus of the present invention.
Figure 9:
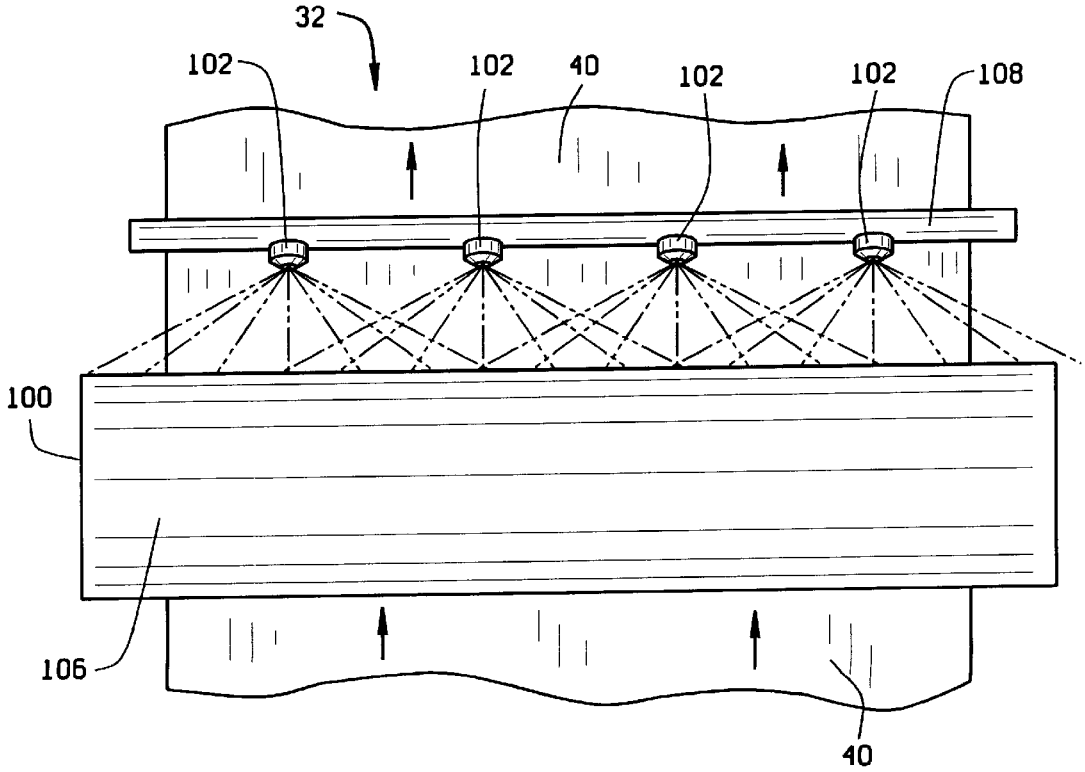
FIG. 9 is a top plan view of the surface conditioning apparatus.

FIG. 8 is an enlarged view of the surface conditioner 32 shown in FIG. 6. FIG. 9 is a top plan view of the surface conditioner 32. As shown in FIGS. 8 and 9, the surface conditioner 32 includes a rotating cleaning brush 100, a plurality of coolant/lubricant sprayers 102, and a back-up roller 104. The cleaning brush 100 includes a mildly abrasive conditioning surface 106 having a generally cylindrical configuration.

Cleaning brushes manufactured by Minnesota Mining and Manufacturing (3M) under the name Scotch-Brite®, or their equivalent, are suitable for use in the surface conditioner 32 of the present invention. In these brushes, abrasive particles are bonded to synthetic (e.g., nylon) fibers of the brush with a resin adhesive. The brush fibers of the Scotch-Brite® (product are of an open-web construction, which gives the fibers a spring-like action that conforms to irregular surfaces and prevents surface gouging. Scotch-Brite® brand cleaning brushes are available in a variety of grades of coarseness and fiber density, though suitable cleaning brushes manufactured by others could be used without departing from the scope of the present invention. Selection of the proper grade will depend on the particular cleaning or finishing application, and is well within the skill of one of ordinary skill in the art.

As shown in FIG. 8, the cleaning brush 100 is preferably positioned above the sheet metal strip 40 for engagement with the top surface thereof. Preferably, the cleaning brush 100 is rotated in a direction against the movement of the strip through the surface conditioner 32 (clockwise as viewed in FIG. 8, with the strip 40 advancing from left to right). The back up roller 104 engages against the bottom surface of the strip 40 opposite the cleaning brush 100 and applies an upward force equal and opposite to the downward force applied by the cleaning brush 100. Preferably, the back up roller 104 moves in the same direction as the strip 40 (clockwise as viewed in FIG. 8). The back up roller 104 may be powered to assist in advancing the strip 40 through the surface conditioner 32. Although the present invention has been described as having one cleaning brush positioned for engagement with the top surface of the strip 40, additional brushes positioned for engagement with the upper and/or lower surfaces of the strip could be used without departing from the scope of the invention.

Preferably, a spray bar 108 having a plurality of sprayer nozzles 102 is positioned just downstream of the cleaning brush 100, with the sprayer nozzles 102 aimed generally toward the point of engagement of the cleaning brush 100 and the top surface of the strip 40. The sprayer nozzles 102 apply a coolant/lubricant, such as water, to the cleaning brush 100 during operation of the surface conditioner 32. Preferably, the coolant/lubricant is applied at the rate of about 4 to 6 gallons per minute per 12" length of the cleaning brush 100. This enhances performance of the surface conditioner 32 by producing a cooler running operation, by washing away cleaning by-products (scale and smut removed by the abrasive surface of the brush), and by extending the life of the cleaning brush 100. As shown in FIG. 9, the spray nozzles 102 are preferably positioned to apply the coolant/lubricant in an overlapping spray pattern so that, if one of the nozzles gets plugged, adjacent nozzles can maintain substantially complete coverage. While the spray bar 108 positioned just downstream of the cleaning brush 100 is important for proper performance, additional spray bars (not shown) may be added at other locations upstream and downstream of the cleaning brush 100 and back up roller 104.

To be effective, the surface conditioner 32 requires a very flat surface. While 3M Scotch-Brite® type cleaning brushes have been used for cleaning smut from the rollers used in temper passing processes, they have not been used to condition the surface of sheet metal itself. It has been found that roller leveling and temper passing processes do not achieve sufficient flatness for this type of surface conditioning process.

Again, as shown in FIG. 6, the surface conditioner 32 is positioned just downstream of the stretcher leveler 30. Thus, in operation of the stretcher leveler 30 and surface conditioner 32 together, the feeding mechanism of the stretcher leveler 30 advances the sheet metal strip 40 through both the stretcher leveler 30 and the surface conditioner 32 at precisely measured increments to perform successive stretching operations in the manner described above. Preferably, the cleaning brush 100 of the surface conditioner 32 is moveable upwardly and downwardly a short distance relative to the strip 40 by hydraulic actuators (not shown). During the incremental advances of the strip 40, the hydraulic actuators are energized to move the cleaning brush 100 into firm engagement with the top surface of the strip 40, the cleaning brush 100 rotating against the direction of movement of the strip 40 all the while. Preferably, between the incremental advances of the strip 40 (while the strip is temporarily stationary and the clamping mechanisms 72 of the stretcher leveler 30 are clamping down on the strip 40), the actuators are released so that less force is applied by the brush 100 to the top surface of the strip until the strip starts moving again. In addition, or as an alternative to reducing the force applied by the brush 100, rotation of the brush may be stopped or slowed between the incremental advances of the strip 40 while the strip is temporarily stationary.

While the present invention has been described by reference to specific embodiments and specific uses, it should be understood that other configurations and arrangements could be constructed, and different uses could be made, without departing from the scope of the invention as set forth in the following claims.

What is claimed is:

1. A method of processing sheet metal comprising the steps of:

providing a stretcher-leveling apparatus;

providing a surface conditioning apparatus having at least one rotating conditioning member;

only linearly stretching at least a portion of a metal sheet past its yield point with the stretcher-leveling apparatus an amount sufficient to eliminate internal residual stresses in the portion of the metal sheet; and conditioning a surface of the portion of the metal sheet with the surface conditioning apparatus by bringing the at least one rotating conditioning member into engagement with the surface of the portion of the metal sheet in a manner to remove scale from the surface of the portion of the metal sheet.

2. The method of claim 1 wherein the step of conditioning a surface of the portion of the metal sheet with the surface conditioning apparatus is performed after the step of stretching the portion of the metal sheet with the stretcher-leveling apparatus.

3. The method of claim 1 wherein the stretcher-leveling apparatus includes a first set of gripping members and a second set of gripping members spaced from the first set of gripping members, and wherein the step of stretching a portion of the metal sheet with the stretcher-leveling apparatus includes the steps of:

gripping the metal sheet with the first and second sets of gripping members; and moving the first and second sets of gripping members in opposite directions from one another to stretch the portion of the metal sheet between the first and second sets of gripping members.

4. The method of claim 1 wherein the at least one rotating conditioning member includes a generally cylindrical conditioning surface, and wherein the step of conditioning a surface of the portion of the metal sheet with the surface conditioning apparatus includes the step of bringing the generally cylindrical conditioning surface of the rotating conditioning member into engagement with the surface of the portion of the metal sheet in a manner to remove scale and corrosion from the surface of the portion of the metal sheet.

5. The method of claim 4 wherein the surface conditioning apparatus further comprises at least one coolant sprayer and wherein the step of conditioning the surface of the portion of the metal sheet with the surface conditioning apparatus includes the step of applying a coolant to the rotating conditioning member with the at least one coolant sprayer.

6. A method of leveling and surface-conditioning sheet metal, the method comprising the steps of:

providing a stretcher-leveling apparatus having a first pair of gripping members and a second pair of gripping members spaced from the first pair of gripping members;

providing a surface conditioning apparatus having at least one rotating conditioning member with a generally cylindrical conditioning surface;

feeding a metal sheet to be stretched into the stretcher-leveling apparatus;

gripping the metal sheet with the first and second pairs of gripping members;

stretching a portion of the metal sheet between the first and second pairs of gripping members by moving the first and second pairs of gripping members in opposite directions from one another; and conditioning a surface of the portion of the metal sheet with the surface conditioning apparatus by bringing the generally cylindrical conditioning surface of the rotating conditioning member into engagement with the surface of the portion of the metal sheet in a manner to remove scale from the surface of the portion of the metal sheet.

7. The method of claim 6 wherein the step of conditioning a surface of the portion of the metal sheet with the surface conditioning apparatus is performed after the step of stretching the portion of the metal sheet.

8. The method of claim 6 wherein the surface conditioning apparatus comprises at least one coolant sprayer, and wherein the step of conditioning the surface of the portion of the metal sheet with the surface conditioner includes the step of applying a coolant to the rotating conditioning member with the at least one coolant sprayer.

9. A method of leveling and surface-conditioning a continuous length of sheet metal, in-line, with successive stretching and conditioning operations, the method comprising the steps of:

providing a stretcher-leveler having an input end, an output end, and a stretching mechanism between the input and output ends;

providing a surface conditioner adjacent the stretcher-leveler, the surface conditioner having at least one rotating conditioning member;

advancing the continuous length of sheet metal through the stretcher-leveler in a manner so that successive adjacent portions of the continuous length of sheet metal are only linearly stretched by the stretching mechanism of the stretcher-leveler in successive stretching operations; and advancing the continuous length of sheet metal through the surface conditioner and into engagement with the rotating surface conditioning member so that successive adjacent surface portions of the sheet metal are conditioned by the rotating conditioning member in a manner to remove scale from the surface portions of the sheet metal.

10. The method of claim 9 wherein the surface conditioner is adjacent the output end of the stretcher-leveler, and wherein the step of advancing the continuous length of sheet metal through the surface conditioner is performed after the step of advancing the continuous length of sheet metal through the stretcher-leveler.

11. The method of claim 9 wherein the step of advancing the continuous length of sheet metal through the surface conditioner includes advancing the continuous length of sheet metal in a downstream direction and rotating the at least one rotating conditioning member in an upstream direction against the continuous length of sheet metal.

12. A metal processing apparatus comprising:

a stretcher-leveler having an input end, an output end, and a stretching mechanism between the input and output ends, the input end of the stretcher-leveler being adapted to receive at least a portion of a metal sheet to be processed, the stretching mechanism having a plurality of gripping members adapted for gripping the portion of the metal sheet and stretching the portion of the metal sheet past its yield point to eliminate internal residual stresses therein, the stretcher-leveler being adapted to discharge the portion of the metal sheet from the output end of the stretcher-leveler after the portion of the metal sheet has been stretched; and a surface conditioner adjacent the output end of the stretcher-leveler, the surface conditioner being adapted to receive the portion of the metal sheet from the output end of the stretcher-leveler, the surface conditioner having at least one rotating conditioning member adapted for engagement with a surface of the portion of the metal sheet in a manner to remove scale from the surface of the portion of the metal sheet.

13. The apparatus of claim 12 wherein the rotating conditioning member of the surface conditioner has a substantially cylindrical conditioning surface adapted for engagement with the surface of the portion of the metal sheet in a manner to remove scale and corrosion from the surface of the portion of the metal sheet.

14. The apparatus of claim 12 wherein the surface conditioner includes at least one coolant sprayer adjacent the rotating conditioning member for applying a coolant to the rotating conditioning member.

15. The apparatus of claim 14 wherein the surface conditioner includes a plurality of coolant sprayers adjacent the rotating conditioning member for applying coolant to the rotating conditioning member while the cylindrical conditioning surface of the rotating conditioning member is in engagement with the surface of the portion of the metal sheet.

16. A metal processing apparatus comprising:

a stretcher-leveler having a plurality of gripping members adapted for gripping a metal sheet to be processed, the gripping members being adapted for stretching at least a portion of the metal sheet past its yield point to eliminate internal residual stresses therein; and a surface conditioner adjacent the stretcher-leveler, the surface conditioner having at least one rotating conditioning member adapted for engagement with a surface of the portion of the metal sheet in a manner to remove scale from the surface of the portion of the metal sheet.

17. The apparatus of claim 16 wherein the stretcher-leveler has an input end and an output end, the stretcher-leveler being adapted to discharge the portion of the metal sheet from the output end of the stretcher-leveler after the gripping members of the stretcher-leveler have stretched the portion of the metal sheet past its yield point, the surface conditioner being positioned adjacent the output end of the stretcher-leveler and being adapted to receive the portion of the metal sheet from the output end of the stretcher-leveler.

18. The apparatus of claim 16 wherein the stretcher-leveler includes a first pair of gripping members and a second pair of gripping members spaced from the first pair of gripping members, the first and second pairs of gripping members each being adapted to firmly grip the metal sheet, the first and second pairs of gripping members being moveable in opposite directions from one another to stretch the portion of the metal sheet between the first and second pairs of gripping members.

19. The apparatus of claim 16 wherein the rotating conditioning member of the surface conditioner has a generally cylindrical conditioning surface adapted for engagement with the surface of the portion of the metal sheet in a manner to remove scale and corrosion from the surface of the portion of the metal sheet.

20. The apparatus of claim 16 wherein the surface conditioner includes at least one coolant sprayer adjacent the rotating conditioning member for applying a coolant to the rotating conditioning member while the rotating conditioning member is in engagement with the surface of the portion of the metal sheet.

21. The apparatus of claim 20 wherein the surface conditioner includes a plurality of coolant sprayers adjacent the rotating conditioning member for applying coolant to the rotating conditioning member while the cylindrical conditioning surface of the rotating conditioning member is in engagement with the surface of the portion of the metal sheet.

* * * * *